US006082820A

United States Patent [19]

Jeng

[11] Patent Number: 6,082,820

[45] Date of Patent: Jul. 4, 2000

[54] RECLINING LOUNGE CHAIR WITH DETACHABLE FULCRUM BASE

[75] Inventor: Chary Jeng, La Mirada, Calif.

[73] Assignee: Berkeley Products, Inc., City of Industry, Calif.

[21] Appl. No.: 09/287,147

[22] Filed: Aug. 5, 1998

[51] Int. Cl.[7] ..... A47C 1/024

[52] U.S. Cl. ..... 297/326; 297/327; 297/440.11; 297/452.13

[58] Field of Search ..... 297/326, 327, 297/440.11, 452.13

[56] References Cited

U.S. PATENT DOCUMENTS

| | | | |
|---|---|---|---|
| D. 167,491 | 8/1952 | Witty | 297/327 X |
| D. 180,458 | 6/1957 | Pearlstine | 297/326 X |
| 2,509,451 | 5/1950 | Reinholz | 297/440.11 X |
| 2,675,857 | 4/1920 | Bloom | 297/326 X |
| 3,591,233 | 7/1971 | Turcksin | 297/440.11 |
| 4,790,599 | 12/1988 | Goldman | 297/327 |

FOREIGN PATENT DOCUMENTS

| | | | |
|---|---|---|---|
| 1366034 | 6/1964 | France | 297/326 |
| 761805 | 11/1956 | United Kingdom | 297/327 |
| 1257927 | 12/1971 | United Kingdom | 297/440.11 |

*Primary Examiner*—Peter M. Cuomo
*Assistant Examiner*—Rodney B. White
*Attorney, Agent, or Firm*—Frank Frisenda

[57] ABSTRACT

An improved reclining lounge chair is provided having a distended tubular frame surrounding a fabric base. The fabric base comprises a seat portion, a leg rest portion, and an upper back rest portion. The distended frame is detachably mounted within a fulcrum base member that permits pivoting adjustment of the frame between an upstanding or reclining position. In a presently preferred embodiment, the fulcrum base member further comprises two arm supports and a first arcuate stop bar that cooperates with a second arcuate stop bar disposed on the back rest portion of the tubular frame to limit the motion of the frame in a reclining position.

5 Claims, 4 Drawing Sheets

RECLINING LOUNGE CHAIR WITH DETACHABLE FULCRUM BASE

BACKGROUND OF THE INVENTION

The present invention relates to an improved reclining lounge chair with adjustable positioning.

With the advent of increasing leisure time, outdoor lawn and garden entertainment continues to gain popularity, thus increasing the desire for attractive yet durable outdoor furniture. To supply such furniture to a growing market in a cost efficient, convenient manner, ready-to-construct and easy-to-knock-down furniture has become a demanded necessity. The desirability of ready to assemble furniture components is based upon lower attendant shipping and storage costs for the wholesaler and retailer.

One drawback of many conventional reclining chairs is the necessity of intricate construction to achieve foldability of the chair generally having intricate mechanism for adjustable positioning of, for instance, the back rest or leg rest portion of the chair. Accordingly, such reclining chair constructions do not allow for ease of assembly in the ready to construct and easy to knock down furniture marketplace. Moreover, the intricacy of the adjustment mechanism lose their integrity over time and normal wear, for instance, through expose to the elements such as sunlight salt water and ocean air. Typical of such conventional foldable reclining chairs is that disclosed in U.S. Pat. No. 2,195,091 issued Lorenz, et al. Lorenz discloses a foldable reclining chair, in which a leg rest—a seat, a back rest and connecting link means are pivotally interconnected with each other to form a polygonal structure with unequal sides and wherein said polygonal structure is movably connected to the support.

Canadian Patent No. 492,371 also discloses a foldable reclining chair, wherein the back rest and the seat form two members of the polygonal link-system springably mounted on a support, wherein a controlling mechanism is provided for controlling the movements of the pivotally interconnected members of the polygonal link-system during a movement from one position into another one when the chair is set up, and wherein the polygonal link-system and said support are foldable so that the chair may be collapsed.

Vanderminden, in U.S. Pat. No. 3,037,811, discloses a collapsible chair, wherein the front and rear legs have their upper ends pivotally connected together. The back rest and seat portion are pivotally connected by means which rest on the rest legs. Arms are provided which are pivotally mounted on the back rest on one end and are end provided with an adjustable connection on the other end. Means are positioned on the rear legs which cooperate with adjustable connections on the arms to make possible the adjustment of the relative position of the back rest and seat.

Luckhardt, in U.S. Pat. No. 3,210,645, discloses a foldable reclining chair including a pair of connected front legs and pair of connected rear legs being pivotally connected with each other for collapsing and setting up the support, a linkage having stationary link-means and a plurality of movably links, the stationary link-means being included in the support wherein the latter is set up. The moveable links include a seat member and a back rest and a guiding link and a chain of connecting links including a top connecting link at one end of the chain and a front connecting link at the other end of the chain.

Other conventional lounge chair embodiments are disclosed in U.S. Pat. No. 532,676 (E. H. Lovejoy); U.S. Pat. No. 388,350 (E. Eshleman); U.S. Pat. No. 1,860,867 (J. D. Matthews); U.S. Pat. No. 1,952,296 (H. E. Taylor); and U.S. Pat. No. 5,570,926 (Elie Papiernik);

Those skilled in the art, however, have recognized a significant need for attractiveness of the outdoor furniture that possesses the virtues of ready-to-assemble and easy-to-knock-down. The present invention fulfills these needs.

SUMMARY OF THE INVENTION

The present invention provides an improved reclining lounge chair having a distended tubular frame surrounding a fabric base. The fabric base comprises a seat portion, a leg rest portion, and an upper back rest portion. The distended frame is detachably mounted within a fulcrum base member that permits pivoting adjustment of the frame between an upstanding or reclining position. In a presently preferred embodiment, the fulcrum base member further comprises two arm supports and a first arcuate stop bar that cooperates with a second arcuate stop bar disposed on the back rest portion of the tubular frame to limit the motion of the frame in a reclining position.

In more detail, the back rest portion of the distended frame is sloped with respect to the seat portion of the frame within a prescribed first angular range. The leg rest portion of the distended frame is disposed with respect to the seat portion of the frame within a prescribed second angular range. Accordingly, the distended tubular frame provides for balanced forward and rearward movement when mounted within the detachable fulcrum base member. The user of the unique reclining lounge chair will thus position the distended frame in a reclining, intermediate or upstanding position by shifting the user's body weight with respect to the pivot elements of the fulcrum base member.

The present invention thus provides a durable and attractive lounge chair construction that is easy to knock-down and convenient to assemble.

DETAILED DESCRIPTION OF THE PREFERRED EMBODIMENTS

The present invention provides an improved reclining lounge chair having a distended tubular frame surrounding a fabric base. The fabric base comprises a seat portion, a leg rest portion, and an upper back rest portion. The distended frame is detachably mounted within a fulcrum base member that permits pivoting adjustment of the frame between an upstanding or reclining position. In a presently preferred embodiment, the fulcrum base member further comprises two arm supports and a first arcuate stop bar that cooperates with a second arcuate stop bar disposed on the back rest portion of the tubular frame to limit the motion of the frame in a reclining position.

In more detail, the back rest portion of the distended frame is sloped with respect to the seat portion of the frame within a prescribed first angular range. The leg rest portion of the distended frame is disposed with respect to the seat portion of the frame within a prescribed second angular range. Accordingly, the distended tubular frame provides for balanced forward and rearward movement when mounted within the detachable fulcrum base member. The user of the unique reclining lounge chair will thus position the distended frame in a reclining, intermediate or upstanding position by shifting the user's body weight with respect to the pivot elements of the fulcrum base member.

Figure 1:
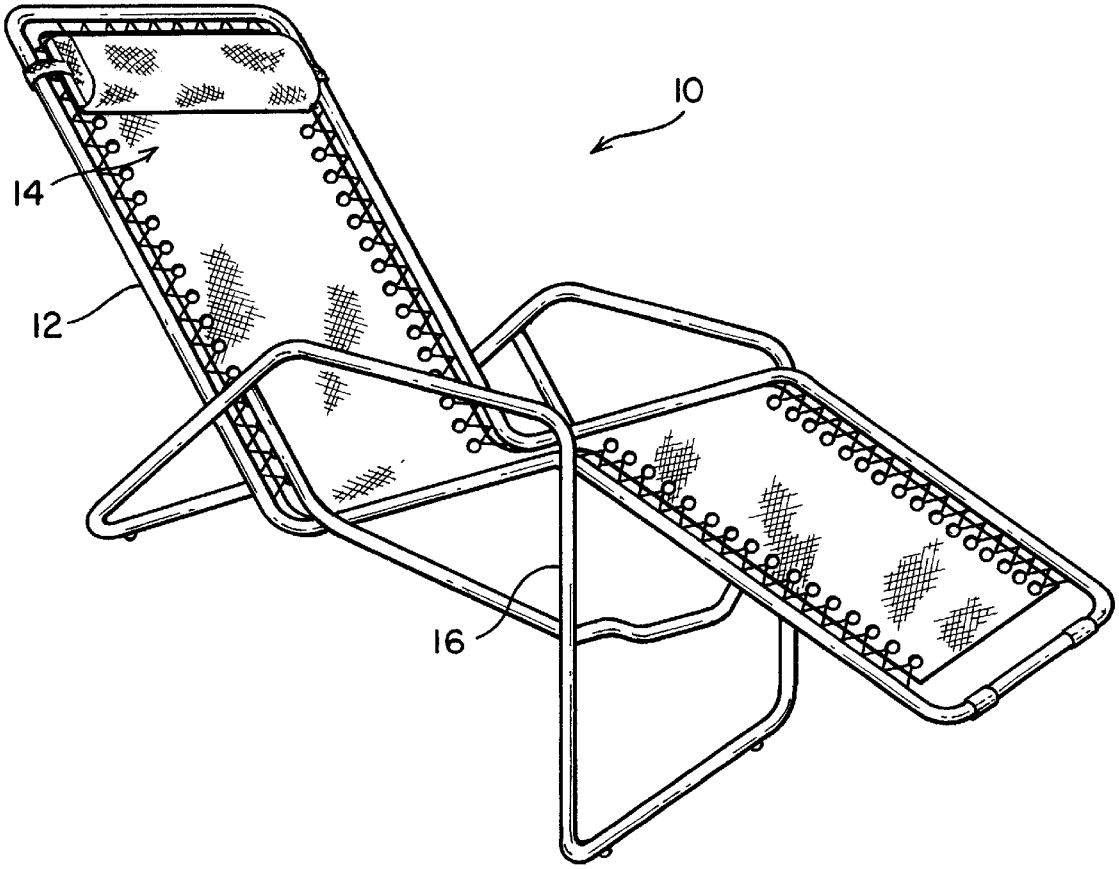
FIG. 1 is a perspective view of one embodied reclining lounge chair with detachable fulcrum base in accordance with the invention.

Referring now to the drawings, FIG. 1 illustrates an improved reclining lounge chair, generally denoted 10, in accordance with one embodiment of the present invention. The lounge chair 10 comprises a distended tubular frame 12 surrounding a fabric base 14. The distended frame 12 is detachably mounted within a fulcrum bases member 16 that permits pivoting adjustment of the frame 12 between an upstanding and reclining position.

Figure 2:
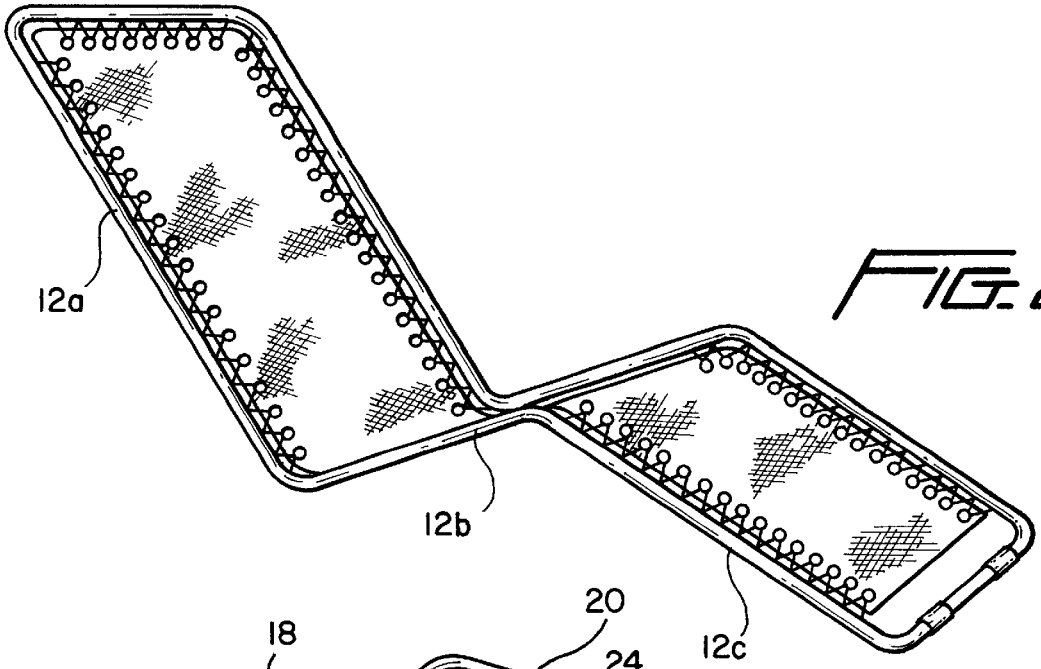
FIG. 2 is a perspective view of one embodied distended tubular frame surrounding a fabric base of the reclining lounge chair depicted in FIG. 1.

As shown most clearly in FIG. 2, the back rest portion 12*a* of the distended frame is sloped with respect to the seat portion 12*b* within a prescribed first angular range. The angle of orientation between the back rest portion 12*a* and the seat portion 12*b* of the distended frame is within a range of from about 100 degrees to about 150 degrees. The leg rest portion 12*c* of the distended frame 12 is disposed with respect to the seat portion 12*b* within a prescribed second angular range. In this respect, the leg rest portion of the distended frame 12*c* is disposed with respect to the seat portion 12*b* of the distended frame within a range of from about 210 degrees to about 260 degrees. The optimum orientation with respect to the back rest portion, seat portion and leg rest portion provides the distended tubular frame with balanced forward and rearward movement when mounted within the detachable fulcrum base member 16. The user of the unique reclining lounge chair 10 will thus position the distended frame 12 in a reclining, intermediate or upstanding position by shifting the user's body weight with respect to the pivot elements 16*a* of the fulcrum base member 16.

Figure 3:
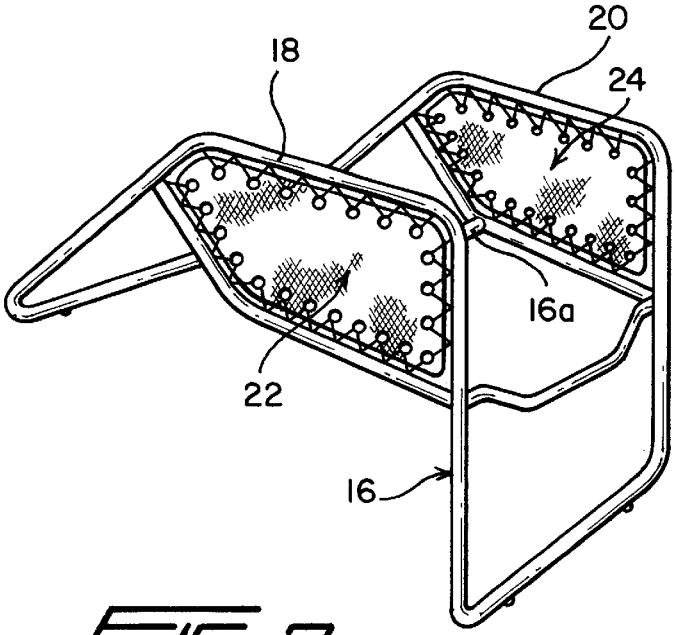
FIG. 3 is a perspective view of a detachable fulcrum base member the reclining lounge chair depicted in FIG. 1.

FIG. 3 illustrates the fulcrum base member 16 detached from the distended frame 12. In a presently preferred embodiment, the fulcrum base member 16 comprises two arm supports 18 and 20 which may optionally include fabric at mid-section fabric liners 22 and 24 to provide an attractive look to the inventive reclining lounge chair 10. The fabric panel 22 and 24 are depicted as having eyelets around the parameter of the panel to permit joinder to the tubular fulcrum base support, for instance by means of interlacing.

Figure 4:
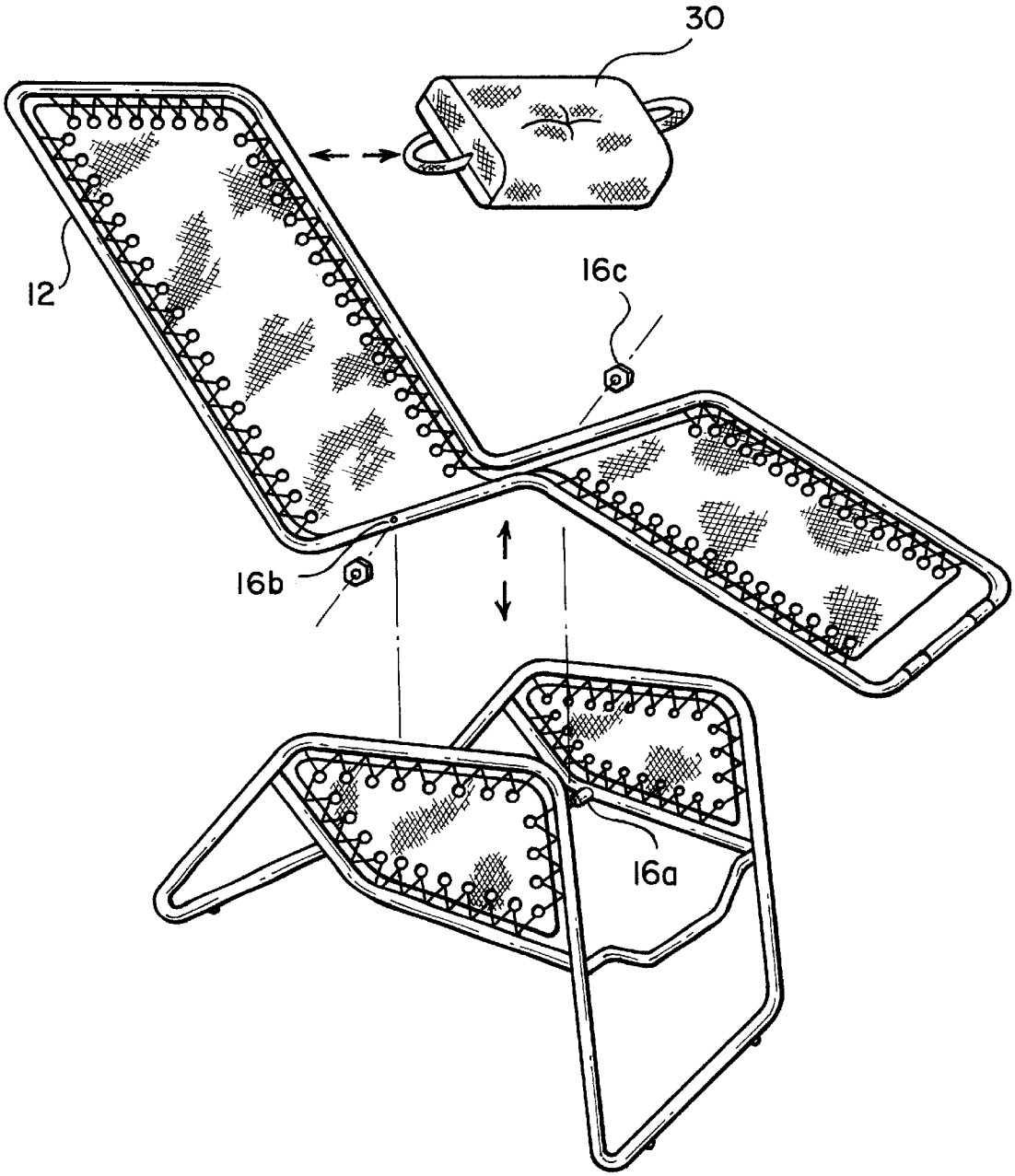
FIG. 4 is an exploded view depicting the distended frame being mounted in the detachable fulcrum base member and optional pillow head rest in accordance with the present invention.

As shown in FIGS. 3 and 4, the fulcrum base 16 further comprises two pivots 16*a* to cooperate with complimentary throughbore provided on with side of the seat portion of the distended frame 12. The pivots 16*a* are mated with the throughbore 16*b* and removeably fixed for instance, by way of mating nuts 16*c*. As further shown in FIG. 4, the reclining lounge chair may also comprise an optional pillow head rest 30 mounted to an upper portion of the distended frame 12. Such mounting may be accomplished by an elastic strap that fits over the upper portion of the distended frame 12 and provide a snug fit with the fabric base.

Figure 5:
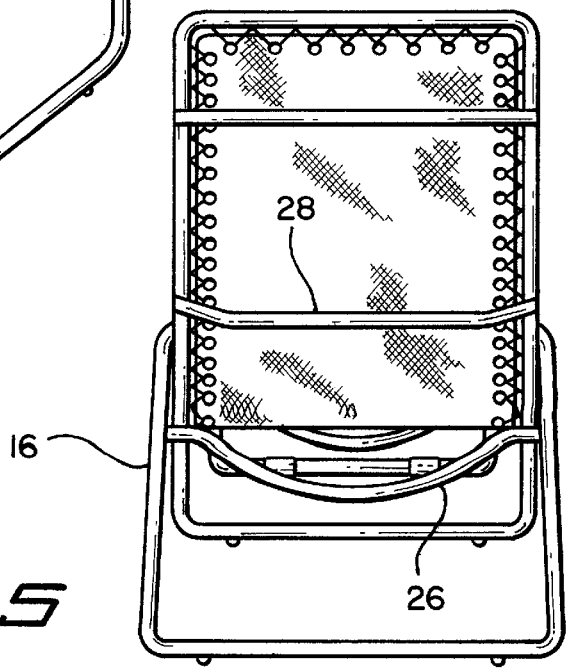
FIG. 5 is a rear view of one embodied reclining lounge chair illustrating the distended frame mounted within the detachable fulcrum base and further depicting a second arcuate stop bar disposed on the rear of the tubular frame to limit the motion of the frame in a reclining position.
Figure 6:
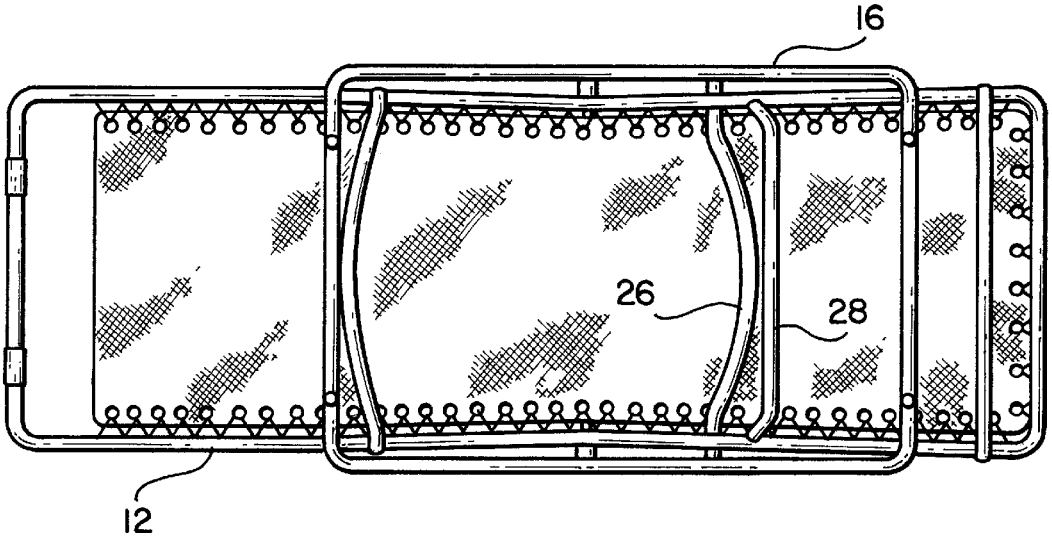
FIG. 6 is a bottom view of one embodied form of the reclining lounge chair in accordance with the present invention.
Figure 7:
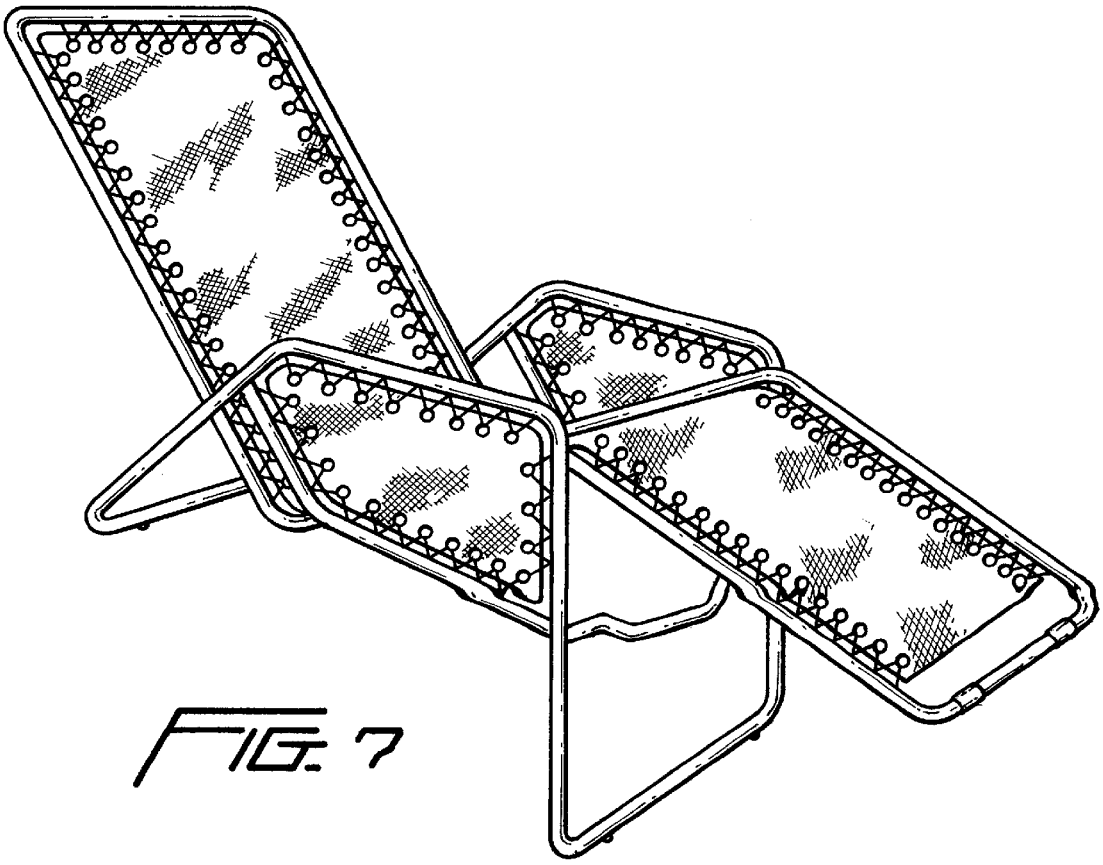
FIG. 7 is a perspective view of one embodied form of the reclining lounge chair in accordance with the present invention.

Also shown in FIGS. 5 and 6 the fulcrum base 16 comprises a first arcuate stop bar 26 that cooperates with a second arcuate stop bar 28 disposed on the rear of the frame 12 to limit the motion of the distended frame in a reclining position (FIG. 6).

I claim:

1. An improved reclining lounge chair, moveable between an upstanding and reclining position, comprising in combination:

a) a distended tubular frame surrounding a fabric base, said tubular frame and fabric base having a front and rear surface comprising a seat portion, a leg rest portion, and an upper back rest portion; said distended tubular frame comprising a first arcuate stop bar disposed on the rear surface of said upper back rest portion;

b) a fulcrum base member comprising two arm supports, a second arcuate stop bar disposed on said base member, and mounting means for detachably mounting said distended tubular frame within said fulcrum base member, said mounting means comprising two distended pivots disposed on said fulcrum base member to cooperate with two complimentary throughbores provided on said distended tubular frame to permit pivoting adjustment of said distended tubular frame between the upstanding and reclining positions, wherein said second arcuate stop bar disposed on said base member cooperates with said first arcuate stop bar disposed on said distended tubular frame to limit the moveability of the distended tubular frame when said lounge chair is in the reclining position.

2. The improved reclining lounge chair as defined in claim 1, wherein the backrest portion of said distended frame is disposed with respect to the seat portion of said distended frame within a range of from about 100 degrees to about 150 degrees.

3. The improved reclining lounge chair as defined in claim 1, wherein the two arm supports of said fulcrum base member comprise fabric panels.

4. The improved reclining lounge chair as defined in claim 1, wherein the front surface of the upper back rest portion of said distended tubular frame further comprises a pillow head rest.

5. The improved reclining lounge chair as defined in claim 1, wherein the leg rest portion of the distended frame is disposed with respect to the seat portion of the distended frame within a range of from about 210 degrees to about 160 degrees.

* * * * *